United States Patent [19]

Taylor

[11] 4,312,089

[45] Jan. 26, 1982

[54] SWIMMING APPAREL FLOTATION DEVICE

[76] Inventor: William F. Taylor, 45 Grove St., Essex, Mass. 01929

[21] Appl. No.: 100,566

[22] Filed: Dec. 5, 1979

[51] Int. Cl.[3] ..... B63B 21/52; B63B 51/02

[52] U.S.Cl. ..... 9/8 R; 114/267; 43/44.92; 2/67; 24/137 R; 9/301; 9/9

[58] Field of Search ..... 43/43.1, 44.92, 44.95; 2/67; 114/267; 9/313, 311, 312, 329, 334, 8 R, 9, 301, 307, 400; 24/137 R, 137 A

[56] References Cited

U.S. PATENT DOCUMENTS

| | | | |
|---|---|---|---|
| 1,617,723 | 2/1927 | Roberts | 9/313 |
| 1,757,277 | 5/1930 | Wegner | 9/313 |
| 1,942,738 | 1/1934 | Zimmer | 43/44.95 |
| 3,041,696 | 7/1962 | Ferri | 24/137 A |
| 3,132,417 | 5/1964 | Irwin | 9/8 R |
| 3,456,457 | 7/1969 | Cass | 2/67 |
| 3,747,257 | 7/1973 | Olsen | 43/44.92 |

FOREIGN PATENT DOCUMENTS

| | | | |
|---|---|---|---|
| 1201632 | 1/1960 | France | 43/44.92 |

*Primary Examiner*—Trygve M. Blix
*Assistant Examiner*—D. W. Keen
*Attorney, Agent, or Firm*—Weingarten, Schurgin & Gagnebin

[57] ABSTRACT

A floatation device to which a swimmer's suit may be secured for retrieval at a later time. The floatation device includes floatation apparatus and apparatus for attaching the bathing suit to the floatation apparatus. The apparatus for attaching the suit to the floatation device may include a spring biased clip, a hole provided in the floatation device, or a pair of narrowly separated fingers extending from the floatation apparatus. The floatation apparatus may be formed of a closed cell synthetic foam formed of a material such as polyethylene, or any other buoyant material.

4 Claims, 12 Drawing Figures

Fig. 7
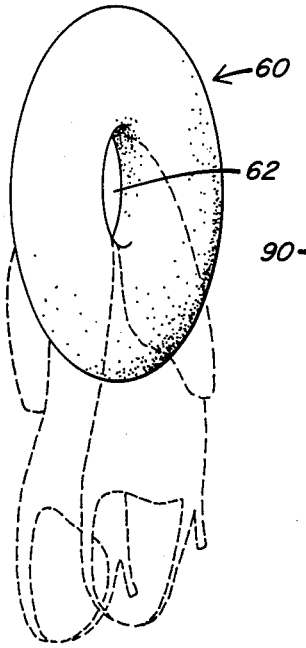
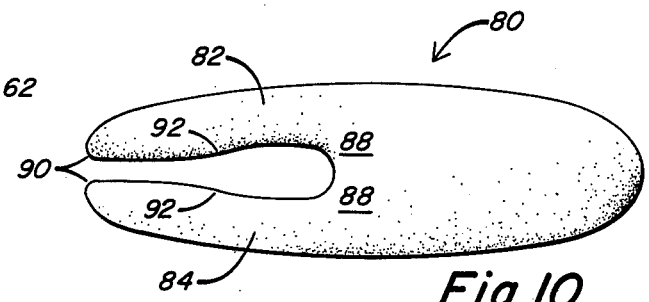
Fig. 10
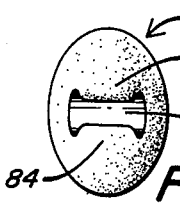
Fig. 11
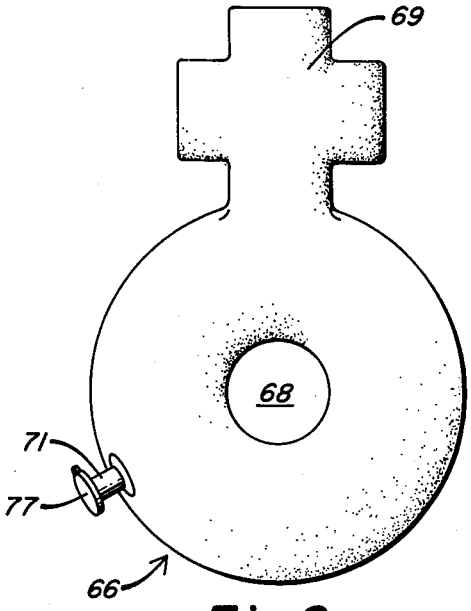
Fig. 8
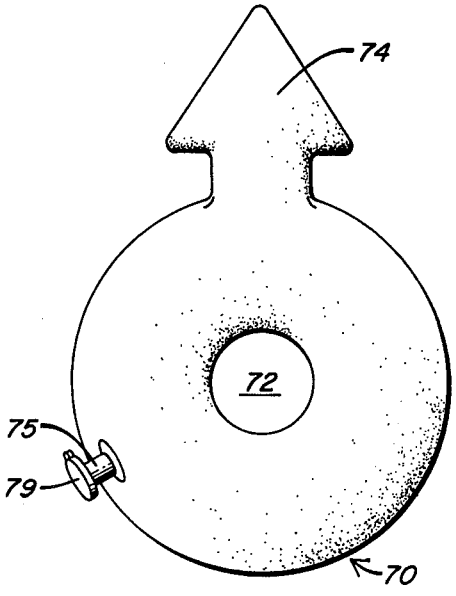
Fig. 9

SWIMMING APPAREL FLOTATION DEVICE

FIELD OF THE INVENTION

This invention relates generally to floatation devices and more particularly to a floatation device for a swimmer's apparel.

BACKGROUND OF THE INVENTION

When a swimmer wishes to swim in the nude, it is often necessary to disrobe on the shore and then to dash rapidly towards the water to avoid being seen. As a result, it is often rather difficult for a person to swim discretely in the nude when there are others around or when there is no convenient place near the water to remove one's clothing. If the swimmer attempts to disrobe in the water, using his position underwater to camouflage his actions, there is no convenient place to leave the bathing suit for retrieval later on. Either the swimmer must toss the garments onshore, or he must give them to another swimmer to hold for him. If the person who wishes to swim in the nude simply disrobes and leaves the suit in the water, it will probably either sink or be carried away by currents, thus preventing the swimmer from leaving the water dressed in his bathing suit. These problems often serve as a severe impedement to one who wishes to go bathing in the nude.

There are presently no devices in the prior art specifically adapted to suspend a bather's suit in the water while he swims in the nude. Inner tubes, commonly available life preservers, buoys and the like are not suitable, since they must be carried around by the swimmer, and their size and bulk makes them inconvenient, and because there are no means provided for securing the suit thereto. Air bags such as that shown in U.S. Pat. No. 1,617,723 and swimming devices, such as that shown in U.S. Pat. No. 1,757,277 are not suitable, since they are large and bulky and since they must first be inflated, a task that is difficult because of their size. Also, there are no means provided for easily and quickly attaching the bathing suit thereto and removing the bathing suit therefrom. Buoyant costume jewelry such as that shown in U.S. Pat. No. 3,456,457 has no provision for securing a bathing suit and is not sufficiently buoyant to support a bathing suit.

SUMMARY OF THE INVENTION

In accordance with the present invention, a floatation device is provided for use by swimmers who wish to disrobe in the water for a swim in the nude. The floation device of this invention is small enough so that it may be easily carried by the swimmer prior to entering the water, or may be secured to the bathing suit with no inconvenience to the swimmer, and thus it may be easily transported to the swimming area. It is also sufficiently large to provide floatation adequate to support a bathing suit in the water and keep it available so that the swimmer may put the suit on when he is finished with his swim in the nude.

In one embodiment of the invention, the floatation device includes an ellipsoidally-shaped float having a clip attached thereto by a flexible connector or arm. The clip may be of an alligator type or one having a spring biased hinge. In one variation of this embodiment, the float may be provided with a hollow space in the center thereof and the float may be capable of being snapped apart so that keys or other valuables may be placed in the hollow space within the float for protection thereof while swimming. In other embodiments, the floatation device may comprise a toroidally shaped float comprised of a synthetic foam. In this embodiment, the bathing suit is inserted through the center hole. In other variations of this embodiment, the toroidally shaped floatation device may be formed of a plastic, inflatable material and may be provided with male or female sexual symbols. In a third embodiment, the floatation device is elongated and has two parallel fingers extending therefrom, between which a bathing suit is inserted.

DESCRIPTION OF THE DRAWING

The invention will be more fully understood from the following detailed description taken in conjunction with the accompanying drawing, in which:

FIG. 7 is a pictorial view of another embodiment of this invention showing the use thereof;

FIG. 8 is a top view of another configuration of the embodiment of FIG. 7;

FIG. 9 is a top view of another configuration of the embodiment of FIG. 7;

FIG. 10 is a side view of another embodiment of this invention;

FIG. 11 is an end view of the embodiment of FIG. 10; and

DETAILED DESCRIPTION OF THE INVENTION

Figure 1:
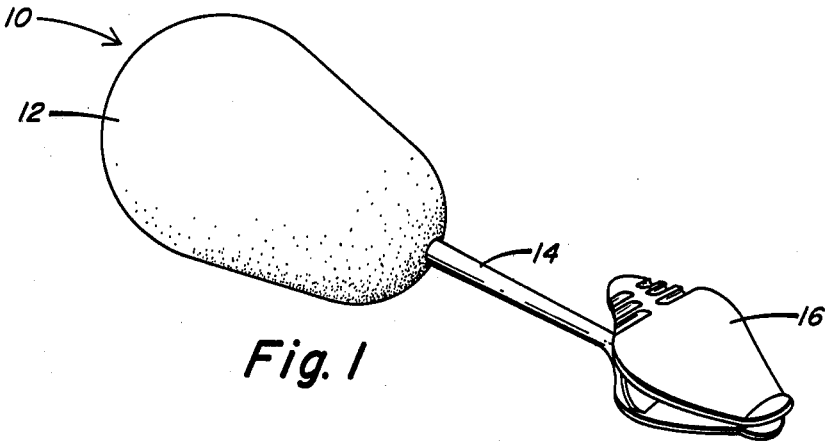
FIG. 1 is a pictorial view of a floatation device embodying the invention.
Figure 4:
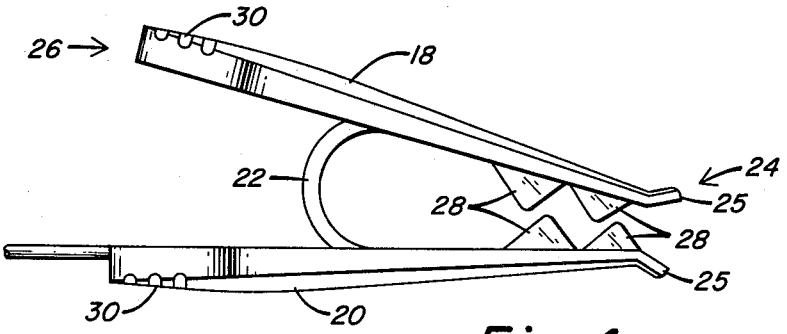
FIG. 4 is a side view of the clip of the embodiment of FIG. 1.

Referring now to FIG. 1, there is shown a floatation device embodying this invention. The apparel floatation device 10 includes a float 12 having a flexible connecting arm 14 extending therefrom. Float 12 preferably is formed in the shape of an ellipsoid or an elongated egg, but it may have any desired shape. Disposed on the distal end of connecting arm 14 is a clip 16, the construction of which is more clearly shown in FIG. 4. Clip 16 includes a pair of jaws 18 and 20 joined by a spring biased hinge 22. Connecting arm 14 is secured to one of jaws 18 and 20, preferably being molded integrally therewith. Jaws 18 and 20 are angularly disposed with respect to one another, converging towards one end 24 facing away from float 12 and diverging towards end 26 which faces towards float 12. Jaws 18 and 20 are spaced the greatest distance at end 26. Jaws 18 and 20 are each provided with interlocking teeth 28 on ends 24 thereof, teeth 28 being adapted to securely engage an item of swimming apparel or any piece of clothing placed therebetween. Jaws 18 and 20 are also each provided with lips 25 which extend outwardly away from teeth 28 and which facilitate the insertion of a garment between jaws 18 and 20 and into teeth 28. Hinge 22 is disposed generally intermediate ends 26 and 24 of jaws 18 and 20 and is secured to the underside of each of jaws 18 and 20. Hinge 22 is spring biased during forming thereof into a coiled position, as shown in FIG. 4, thus urging ends 24 and teeth 28 against each other. Ends 26 of jaws 18 and 20 are each provided with grooves 30 which provide a gripping surface. As shown in FIG. 1, clip 16 preferably has an elongated shape, being narrowest near ends 26 and 24 and widest adjacent hinge 22. Ends 24 and thus teeth 28 may be spread apart by application of a squeezing pressure to ends 26, urging 26 together and thus pivoting jaws 18 and 20 about hinge 22.

Figure 2:
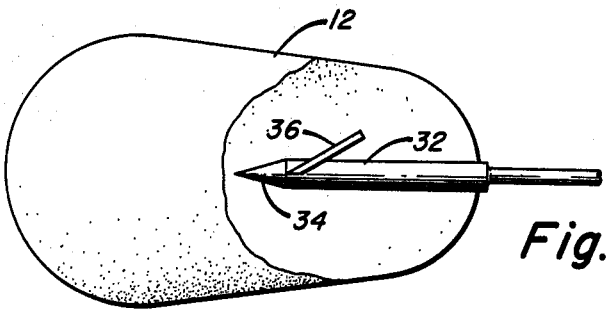
FIG. 2 is a cutaway side view of the embodiment of FIG. 1.
Figure 3:
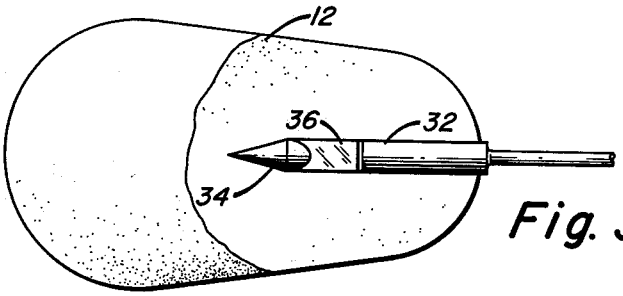
FIG. 3 is a cutaway top view of the embodiment of FIG. 1.

Connecting arm 14 is inserted into float 12 as shown in FIGS. 2 and 3. A portion 32 thereof is imbedded in float 12, portion 32 preferably having a greater diameter than the exposed section of connecting arm 14. Portion 32 terminates in a pointed end 34, preferably disposed at least midway along the length of float 12. Extending outwardly from portion 32 is barb 36 which projects at an acute angle with respect to portion 34 towards clip 16. Barb 36 is adapted to prevent portion 32 from being pulled from float 12 during use thereof.

Figure 5:
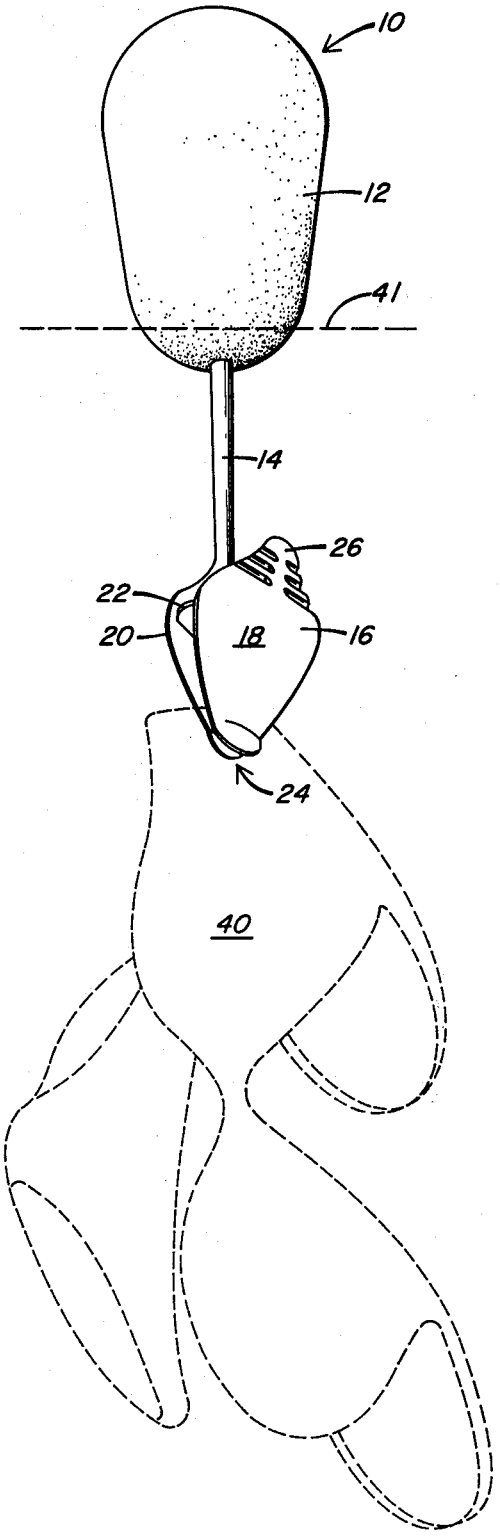
FIG. 5 is a pictorial view showing the embodiment of FIG. 1 in use.
Figure 12:
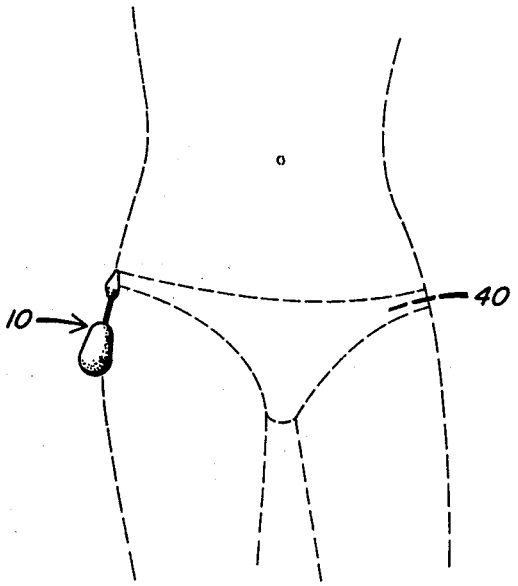
FIG. 12 is a pictorial view showing the embodiment of FIG. 1 as worn by a swimmer.

The use of the floatation device as illustrated in FIGS. 1 through 4 will now be described with reference to FIGS. 5 and 12. Prior to entering the water, a swimmer may either carry the floatation device 10 in his hand, or he may attach device 10 to a portion of his bathing suit 40 by means of clip 16 as shown in FIG. 12. Device 10 is light enough in weight and is sufficiently small so that it may be attached by means of clip 16 to bathing suit 40, where it is permitted to hang without inconvenience to the swimmer or interference with his movements. Once in the water, the swimmer may partially submerge himself and remove his bathing suit 40 and the device 10. The bathing suit 40 is then clipped to device 10 by means of clip 16 and device 10 is released into the water. Float 12 causes device 10 to rise to the surface 41 and float 12 acts to keep device 10 at or near the surface 41 of the water with the bathing suit 40 trailing therefrom, as shown in FIG. 5. Because of the length of float 12 and the extended nature of connector arm 14, the device 10 may assume a slight angle with respect to the surface 41 of the water, or it may have a substantially vertical orientation, as shown in FIG. 5. Thus the bathing suit 40 floats just beneath the surface 41 of the water, securely attached to device 10, so that it may be kept in sight and retrieved by the swimmer upon completion of his swim. Device 10, with bathing suit 40 attached to clip 16, is free to float on the surface 41 of the water, but because of the sea anchor effect of suit 40, device 10 is unlikely to travel far from where it has been released, even in the presence of wind. Clip 16 may be opened for insertion of the bathing suit 40, or opened for removal thereof by squeezing ends 26 of jaws 18 and 20 together to pivot jaws 18 and 20 about hinge 22, separating ends 24 from one another. When squeezing pressure is released from ends 26, the spring bias imparted to hinge 22 causes ends 24 to clamp together again, thus gripping suit 40 between teeth 28. The bias imparted to hinge 22, and the gripping effect of teeth 28 are sufficient to prevent bathing suit 40 from slipping from clip 16 under conditions normally found in most swimming areas.

In a preferred configuration, float 12 typically is about 3.25 inches (8.26 cm) long and about 2 inches (5.08 cm) wide. Clip 16 is about 2 inches (5.08 cm) long and 1.25 inches (3.18 cm) wide at its widest point. Portion 34 may be about 1.25 inches (3.18 cm) long, while connector arm 14 may be of any suitable length.

Figure 6:
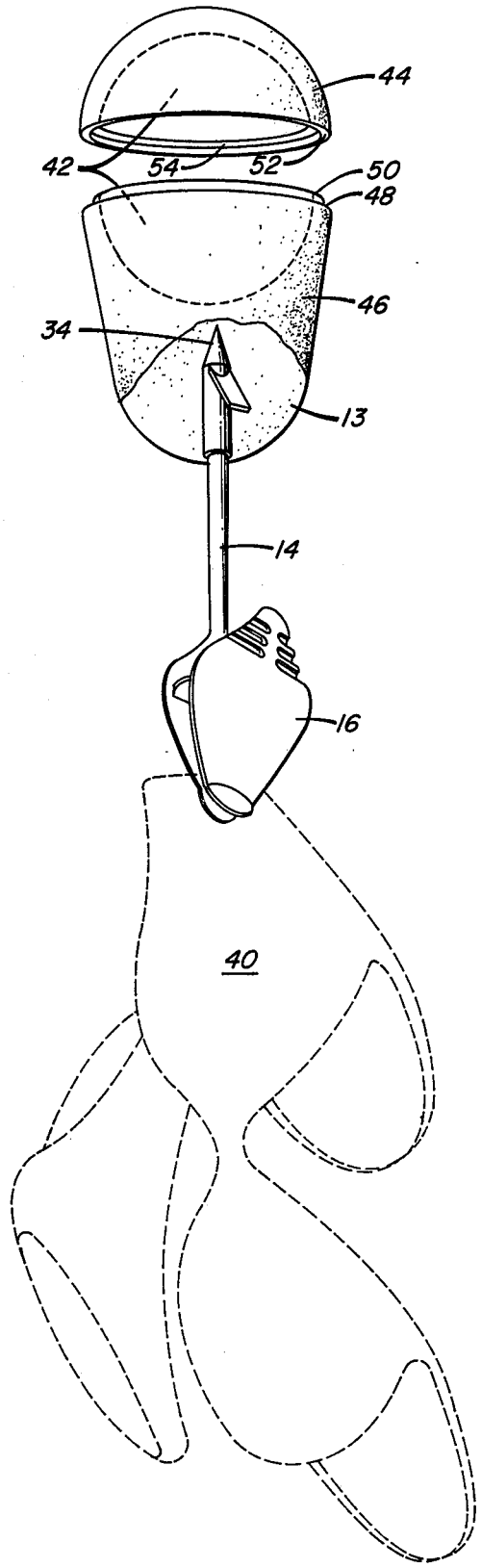
FIG. 6 is a partial cutaway side view of another embodiment of this invention showing a cavity within the float.

An alternative embodiment of FIGS. 1 through 5 is shown in FIG. 6. Because of the similarities between the embodiments of FIG. 6 and FIGS. 1 through 5, like numbers are used for like parts where possible. In FIG. 6, float 13 has a clip 16 disposed on a distal end of connector arm 14 extending therefrom as is shown in FIGS. 1 through 5. Clip 16 is identical to that shown in FIGS. 1 through 5, and connector arm 14 is attached to float 13 as shown in FIGS. 2 and 3. Float 13 in FIG. 6 has a much larger size than that of float 12 in FIGS. 1 through 5, but it has generally the same shape. Float 13 is provided with an interior recess 42 which is disposed between mating halves 44 and 46 of float 13. Recess 42 is disposed rearwardly of point 34 of connector arm 14 so that point 34 does not extend into recess 42. Halves 44 and 46 are both formed of a synthetic foam. Halves 44 and 46 are molded such that half 46 is provided with a ledge 48 extending around the perimeter thereof, and a lip 50 projecting upwardly therefrom. Lip 50 is disposed between ledge 48 and recess 42. Half 44 is provided with a mating lip 52 which extends outwardly therefrom towards half 46, and a ledge 54. Ledge 48 of half 46 is adapted to accept lip 52 of half 44, while ledge 54 of half 44 is adapted to accept lip 50 of half 46. Halves 44 and 46 are designed so that when mated together, lip 50 fits snugly into ledge 54 and lip 52 fits snugly onto ledge 48, thereby holding halves 44 and 46 together. Halves 44 and 46 may be separated by pulling them apart, and they may be mated by pushing them together. Recess 42 is adapted for storage of valuables by a swimmer. Thus, if the swimmer is carrying any keys or loose change, he may pull halves 44 and 46 apart revealing recess 42. The change or keys are then placed in recess 42, and halves 44 and 46 are pushed together tightly, thus preventing the valuables from falling into the water. Bathing suit 40 may then be attached to clip 16. Float 12 is sufficiently large to support both suit 40 and any valuables such as keys or coins which are present in recess 42.

Another embodiment of this invention is shown in FIGS. 7 through 9. With reference now to FIG. 7, a toroidal shaped floatation device 60 is disclosed having a hole 62 formed in the center thereof. Device 60 preferably is composed of a synthetic foam. Hole 62 is sufficiently large to permit a bathing suit to be drawn therethrough, and sufficiently small to retain said apparel therein. Device 60 is sufficiently large to provide enough floatation to support any standard sized bathing suit. In one embodiment, the hole 62 typically has a diameter of about one inch (2.54 cm), while the diameter of device 60 is about 3½ inches (8.89 cm).

Another embodiment of FIG. 7 is shown in FIGS. 8 and 9. Device 66 of FIG. 8 has the basic toroidal shape of the embodiment of FIG. 7, being provided with a generally circular hole 68 in the middle thereof. Extending from one side of device 66 is a cross 69, which denotes the female sex. Similarly, in FIG. 9, a toroidal shaped device 70 is provided with a generally circular hole 72. Device 70 has an arrow 74, denoting the male sex. The embodiments of FIGS. 8 and 9 are preferably inflatable and are provided with valves 71 and 75 respectively for such purposes. A swimmer may inflate devices 66 and 70 by blowing into respective valves 71 and 75, and devices 66 and 70 are retained in an inflated condition by respective snap-on caps 77 and 79. Devices 66 and 70 are small enough that they may be quickly inflated with a minimum of effort.

With reference now to FIGS. 10 and 11, another embodiment of this invention will be described. Floatation device 80 has a generally elongated shape as shown in FIG. 10. Extending therefrom are fingers 82 and 84 forming a space 86 therebetween. Fingers 82 and 84 are spaced farthest apart at point 88 where they join the body of device 80, and this spacing between fingers 82 and 84 is reduced moving away from point 88 toward point 92 located generally midway between point 88 and distal ends 90 of fingers 82 and 84. The distal ends 90 of fingers 82 and 84 preferably have the same spacing as points 92. Device 80 preferably has a somewhat flattened cross-sectional shape, as shown in FIG. 11. This design of fingers 82 and 84 permits a bathing suit to be inserted into cavity 86 past distal ends 90 and points 92 until it is pushed adjacent point 88. The close spacing at point 92 and distal ends 90 ensures that the suit will be held in place by fingers 82 and 84. Device 80 is preferably formed of a synthetic foam and is thus provided with a certain amount of rigidity. As a bathing suit is inserted into cavity 86, fingers 82 and 84 are forced slightly apart. The inherent rigidity of fingers 82 and 84 urges them back to their original position, thus providing a clamping effect on the bathing suit which is inserted therebetween. This feature assures that the suit will not slip from cavity 86 while device 80 floats on the surface of the water. Device 80 preferably is large enough to support a standard sized bathing suit, but not so large as to be cumbersome. In a preferred embodiment, device 80 is 5½ inches (13.97 cm) long and is 1½ inches (3.81 cm) wide at its widest point. Cavity 86 is ½ (1.27 cm) wide at its widest point.

With respect to materials, float 12, device 60, and device 80 are all formed of a buoyant material. Typically this material is compression molded polyethylene, although any closed cell synthetic foam or an open cell synthetic foam covered by a skin would be suitable. Connector 14 and clip 16 are typically formed of polypropylene, while devices 66 and 70 are typically formed of vinyl. Float 12, device 60, device 80, device 66 and device 70 are each sufficiently buoyant to support themselves and a bathing suit, but not so large or so buoyant as to support a much larger or heavier item. Typically, each such device or float has a buoyancy of between one half to three pounds, (0.23 to 1.36 kilograms) depending on the weight of the bathing suit to be attached thereto.

In view of the above description, it is likely that modifications and improvements will occur to those skilled in the art which are within the scope of this invention.

What is claimed is:

1. A device for holding swimming apparel in swimming water comprising:

cellular foam floatation means of ½ to 3 pounds of buoyancy thereby adapted to float said swimming apparel at the surface of a body of water;

clip means for removably attaching said swimming apparel to said floatation means, said clip means having an outwardly opening jaw; and a unitary plastic arm partially embedded within said floatation means and extending to connect said clip means, said unitary arm providing a rod-like attachment between said floatation means and said clip means;

said clip means comprising a first plate formed as a broadened extension of said unitary arm and a second plate resiliently supported from said first plate and having inwardly facing swimming apparel retaining teeth on ends thereof.

2. A device for holding swimming apparel in the water comprising:

floatation means having sufficient buoyancy to float said swimming apparel at the surface of a body of water;

means for removably attaching said swimming apparel to said floatation means, said attaching means comprising a toothed, spring biased clip;

a unitary arm connecting said floatation means to said attaching means; and a lid removable from said floatation means and enclosing a cavity formed within said floatation means, said cavity being adapted for the placement of small objects therein, said lid being securely attachable to said floatation means.

3. A device for holding a swimmer's apparel in the water, comprising:

a buoyant float having an ellipsoidal shape, said float being formed of a closed cell synthetic foam;

an arm having one end inserted into said float, said one end having a barb projecting therefrom within said float toward the other end of said arm;

a spring biased clip disposed at said other end of said arm, said clip comprising:

a first jaw having a second end and a first end extending from and formed rigidly with said arm;

a second jaw having a first end and a second end;

a hinge pivotally securing said first jaw to said second jaw at a point intermediate said first and said second ends of said first jaw and said second jaw, said hinge biasing said second end of said first jaw against said second end of said second jaw and said first end of said first jaw away from said first end of said second jaw;

teeth formed on said second end of said first jaw and on said second end of said second jaw and being adapted to grip an item of swimming apparel placed between said second end of said first jaw and said second jaw;

a lip disposed on said second end of each of said first jaw and said second jaw, said lip extending outwardly away from said teeth and being adapted to facilitate the insertion of an item of swimming apparel between said second end of said first jaw and said second jaw; and gripping surfaces disposed on said first end of said first jaw and on said first end of said second jaw.

4. The device of claim 3, wherein said float has a buoyancy in the range of one half pound to three pounds.

* * * * *